US005454124A

United States Patent [19]

Huang

[11] Patent Number: 5,454,124

[45] Date of Patent: Oct. 3, 1995

[54] FOLDABLE PLAYYARD WITH IMPROVED MECHANISM FOR COLLAPSING THE TOP RAIL STRUCTURE

[76] Inventor: Henry Huang, No. 22 Kuang Fu Rd., Chia Tai, Industrial Tai Pao City, Chia Yi, Hsien, Taiwan

[21] Appl. No.: 180,355

[22] Filed: Jan. 12, 1994

[51] Int. Cl.[6] ..... A47D 7/00

[52] U.S. Cl. ..... 5/99.1; 5/98.1

[58] Field of Search ..... 5/98.1, 98.3, 99.1; 403/321, 322, 325

[56] References Cited

U.S. PATENT DOCUMENTS

| | | | |
|---|---|---|---|
| 2,518,904 | 8/1950 | King . | |
| 3,195,152 | 7/1965 | Gottlieb . | |
| 4,688,280 | 8/1987 | Kohus et al. . | |
| 4,739,527 | 4/1988 | Kohus et al. . | |
| 4,746,140 | 5/1988 | Kassai . | |
| 4,811,437 | 3/1989 | Dillner et al. . | |
| 4,934,025 | 6/1990 | Mariol . | |
| 5,025,517 | 6/1991 | Johnson | 5/99.1 |
| 5,197,154 | 3/1993 | Shamie . | |
| 5,239,714 | 8/1993 | Huang | 5/99.1 |
| 5,241,716 | 9/1993 | Kohus . | |

*Primary Examiner*—Michael F. Trettel
*Attorney, Agent, or Firm*—Young & Thompson

[57] ABSTRACT

A foldable playyard comprises a novel release mechanism for preventing the top frame structure from being inadvertently collapsed. The release mechanism comprises a manually actuated member offset from and positioned alongside one of the rails of the upper frame assembly, which release member frees a hinge/rail pair of the upper frame assembly for 180° rotation to its collapsible position. Collapsing of each hinge/rail pair of the upper frame assembly therefore requires a two-handed operation, by first actuating the manually actuated member, and then grasping the medial hinge and twisting it to impart rotation to each hinge/rail pair assembly, about the axis of the rails. The required manipulation to collapse the top frame assembly therefore could not be inadvertently performed by a child occupying the playyard, yet is nevertheless relatively easy for adults to perform.

9 Claims, 5 Drawing Sheets

FOLDABLE PLAYYARD WITH IMPROVED MECHANISM FOR COLLAPSING THE TOP RAIL STRUCTURE

FIELD OF THE INVENTION

The invention relates to playyards intended to be safely occupied by infants and toddlers. More particularly, the invention relates to such a playyard wherein an improved mechanism is provided for collapsing the top rail structure of the playyard.

BACKGROUND OF THE INVENTION

Collapsible playyards have become popular on the market in recent years, owing to the ease with which they can be folded into a very compact shape for storage and carrying, and then unfolded to provide an area in which an infant or toddler can safely play without straying off.

Examples of such playyards are shown in U.S. Pat. No. 4,811,437 to DILLNER et al. As shown in that patent, playyards of this type include a collapsible frame structure surrounded by a fabric enclosure.

More particularly, FIGS. 5 and 7 of the DILLNER et al. patent show the top rail structure and a release mechanism for collapsing the top rails, so that the playyard can be folded for storage or carrying. In this embodiment, a one-handed operation is effective to collapse the top rail structure, by grasping each medial rail connecting member 110 and squeezing the latch release mechanism 144 upwardly.

Although this is a convenient mechanism for collapsing the top rails, there is also the danger that it could be inadvertently actuated by a toddler playing in the playyard. This is particularly true, given that toddlers frequently stand up in the playyard while grasping the rails of the top rail structure.

Accordingly, FIGS. 13–23 of DILLNER et al. describe alternative embodiments in which, to collapse the top rail structure, it is necessary to rotate the medial rail connecting member and its associated pair of rail members 180°, from the position shown in FIG. 13 to the position shown in FIG. 14. To free this assembly for the 180° rotation about the axis of the tubes, the DILLNER et al. patent describes a pair of oppositely sprung collars at the opposite ends of the tube pair, which must be simultaneously grasped and slid toward each other against the action of a pair of springs. With the user's hands in this position, the top tube assembly is rotated 180° about the axis of the tubes, and thereafter collapsed.

These alternative embodiments therefore provide a two-handed operation for collapsing the top rail structure, which apparently could not be inadvertently performed by a toddler occupying the playyard.

It will be appreciated, however, that because DILLNER et al. provides sprung collars which surround the tubes of the top frame structure, it is necessary to provide two such collars, one at each end of each top rail pair, or else this release mechanism could also be inadvertently actuated by an occupant of the playyard.

Moreover, the structure of these alternative release mechanisms for the top rail structure are believed to be quite awkward to manipulate, even for adults. This is because the adult must rotate the medial connecting member/tube pair assembly 180°, at the same time that his hands are spread quite far apart (particularly in the case of the longer pair of top rails) and grasping the oppositely sprung collars and pushing them against the action of their associated springs.

OBJECTS OF THE INVENTION

It is accordingly a principal object of the invention to provide a foldable playyard for safe occupancy by a small child, the playyard having an improved mechanism for collapsing the top rail structure.

It is a further object of the invention to provide a playyard structure having an improved mechanism for collapsing the top rail structure, which could not be inadvertently actuated by a child occupying the playyard.

It is a still further object of the invention to provide a playyard having an improved mechanism for collapsing the top rail structure, which requires a two-handed operation for its actuation, but is nevertheless convenient to use.

SUMMARY OF THE INVENTION

The above and other objects of the invention are achieved in a playyard structure in which a pair of top rail members and an intermediate hinge are conjointly rotated 180° about the axis of the rail members in order to collapse the top rail structure, wherein a single release mechanism is provided per rail pair, by virtue of a novel construction of the release mechanism that permits it to be located offset from the axis of the rail members, preferably underlying the rail members in each corner of the playyard.

In preferred embodiments of the invention, the rail members of each rail pair are interconnected by an intermediate hinge having a pivot axis perpendicular to and offset from the axis of the rail members, the hinge thereby providing a convenient hand-hold for rotating the hinge/rail pair assembly 180° about the axis of the rail members.

BRIEF DESCRIPTION OF THE DRAWINGS

The invention will now be described in greater detail in connection with various preferred embodiments thereof, and with reference to the accompanying drawings, in which.

DETAILED DESCRIPTION OF THE PREFERRED EMBODIMENTS

Figure 1:
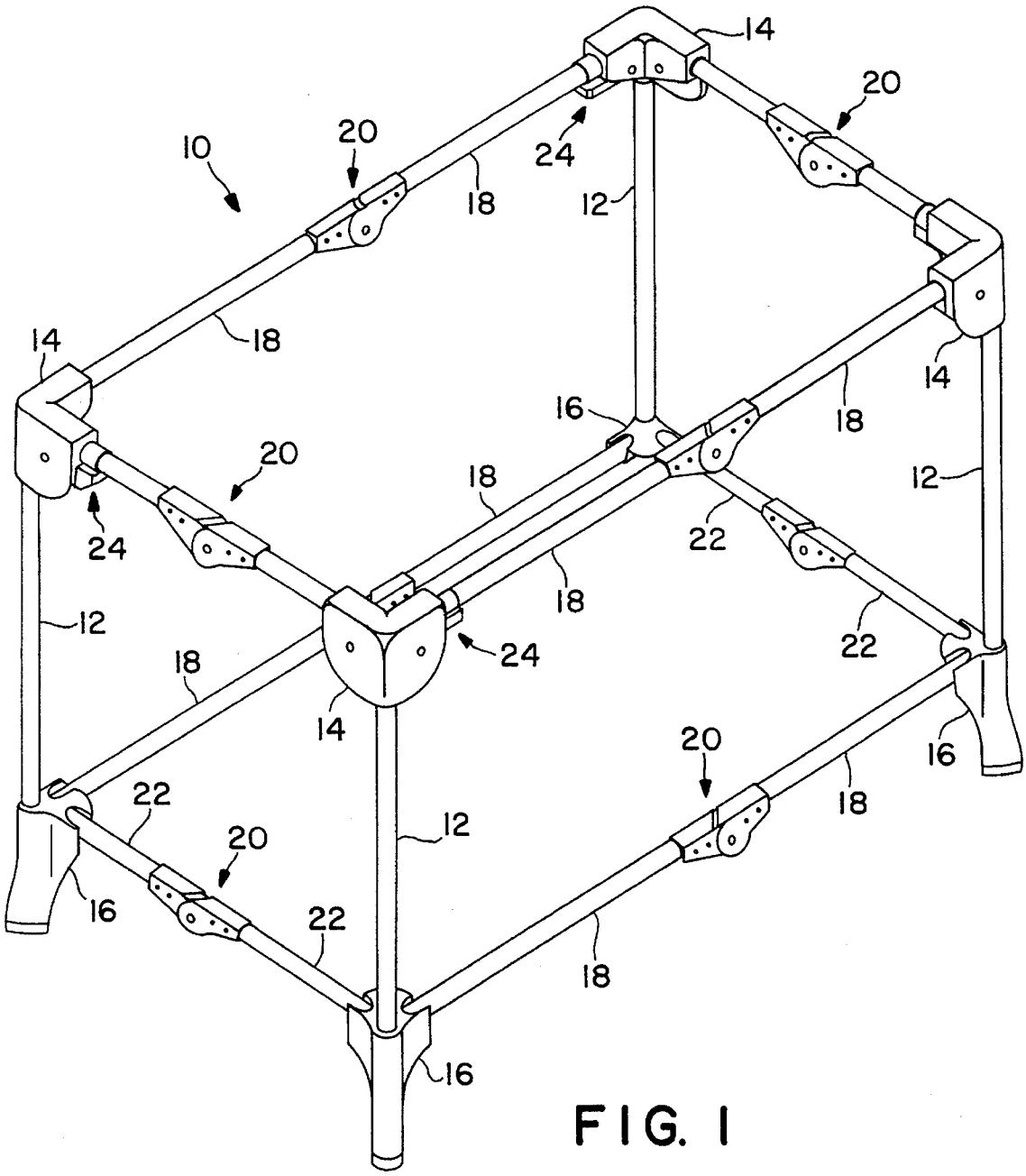
FIG. 1 is a perspective view of a frame for a foldable playyard, which incorporates the novel top rail release mechanism according to the invention.

FIG. 1 shows a frame for a foldable playyard, embodying the present invention. As discussed above, the complete playyard will include not only the depicted frame, but also a suitable fabric enclosure surrounding the frame and enclosing most of the rails.

More particularly, FIG. 1 shows a playyard frame having corner floor supports 16 to which are pivotably mounted shorter side rail tubes 22 and longer side rail tubes 18 forming the bottom frame structure. Vertical tubes 12 are rigidly mounted in the corner floor supports 16, and are also rigidly mounted at their opposite ends in upper corner connecting members 14.

The upper framework is likewise formed of longer side rail tubes 18 and relatively shorter side rail tubes 22. Whereas the tubes 18, 22 of the lower framework are merely pivotably mounted in the corner floor support members 16, the corresponding tubes 18, 22 of the upper framework are mounted in the corner mounting members 14 not only for pivotal movement about an axis transverse to the tubes, but also for rotational movement about the axis of the tubes.

Each adjacent pair of tubes 18, 22, is interconnected by a hinge 20. Specifically, the adjacent ends of each pair of tubes 18, 22 are rigidly mounted to respective halves of hinge 20, with hinge 20 pivoting about an axis transverse to the tube axis and offset therefrom.

Reference is made in this regard to U.S. Pat. No. 4,934,025 to John V. MARIOL, which shows in its FIGS. 2–7 a hinge that is somewhat similar in appearance. In this patent, however, the mounting of the tube pair in the hinge permits 180° movement of the hinge relative to the tube pair, for collapsing of the playyard. By contrast, in the present invention, the tube pair 18, 18 or 22, 22 is rigidly mounted to the opposite ends of hinge 20, with the tube pair 18, 18 or 22, 22 being rotatable conjointly with the hinge 20, over the 180° range, for collapsing the upper frame structure.

It will be appreciated that no 180° rotation is necessary to collapse the bottom frame structure, as these rails may be collapsed simply by pushing upwardly on the hinges 20 or the portions of tubes 18, 22 adjacent the hinges.

It will also be appreciated that the construction of hinges 20 according to the invention, particularly with the offset hinge axis, provides a convenient hand-hold for grasping hinge 20 and twisting the hinge to rotate the assembly of hinge 20 and tube pair 18, 18 or 22, 22 180° about the axis of the tubes.

According to the invention, each corner of the upper frame structure of the playyard is provided with a single release mechanism 24, which must be actuated in order to free the associated hinge/tube pair assembly for rotation into the collapsible position.

Figure 2:
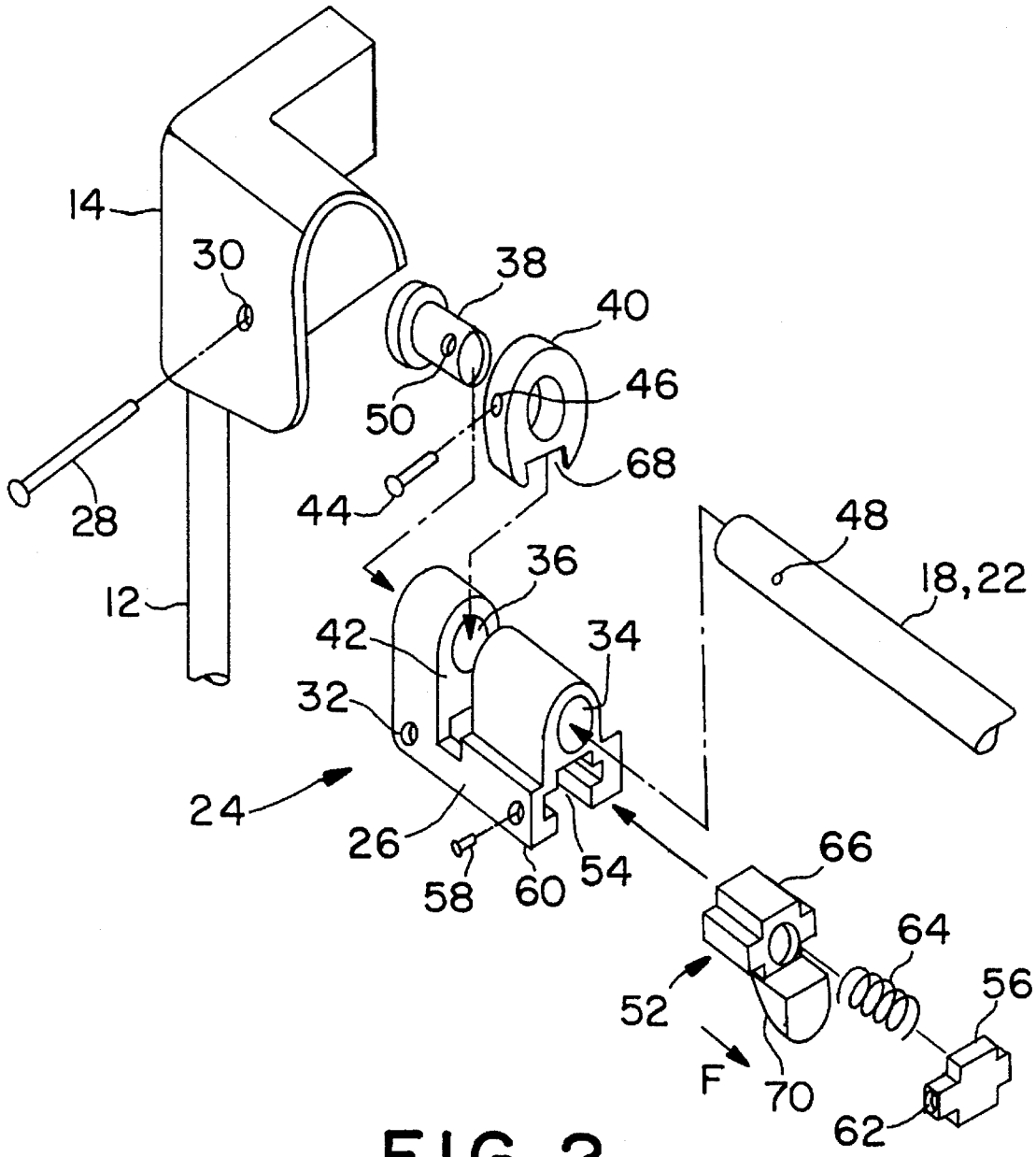
FIG. 2 is an exploded view showing the top rail release mechanism according to a first embodiment of the invention.

A first embodiment of the release mechanism according to the invention is shown in FIG. 2. As seen therein, the corner connecting member 14 receives a specially constructed mounting block 26, which is pivotably mounted to the corner connecting member 14 by a pin 28 passing through a bore 30 in corner connecting member 14 and an aligned bore 32 in mounting block 26. Although not visible in FIG. 2, corner connecting member 14 includes a similar bore 30 on its inside flank, and mounting block 26 includes an additional bore 32 on its aligned inside flank, so that pivot pin 28 may pass all the way through the corner connecting member 14 and mounting block 26.

One of the tubes 18, 22 of a tube pair 18, 18 or 22, 22 of the top frame assembly is received in a pair of aligned complementary bores 34, 36 of the mounting block 26. It is secured in the mounting block by an end plug 38 which is fitted inside the end of the tube 18, 22, as well as by a collar 40 surrounding the tube 18, 22, whose function will be described below. More particularly, collar 40 is received within a cut-out section 42 of the mounting block 26, with a screw 44 passing first through a bore 46 in collar 40, next through an aligned bore 48 in the tube 18, 22, and then into an aligned bore 50 in end plug 38.

End plug 38 and collar 40 are therefore rigidly mounted to tube 18, 22. However, the assembly of tube 18, 22, collar 40 and end plug 38 are free to rotate relative to mounting block 26. On the other hand, mounting block 26 cannot rotate relative to the corner mounting member 14, due to the traversing pivot pin 28, as well as the complementary elongated shape of tire outer surface of mounting block 26 and the inner surface of corner connecting member 14.

The entire assembly of tube 18, 22, collar 40, end plug 38 and mounting block 26 is therefore pivotable about the pivot pin 28, provided that the associated hinge 20 shown in FIG. 1 has been rotated 180° to its inverted collapsible position.

The release mechanism 24 shown in FIG. 2 further comprises a manually-actuated slide block 52 received in a correspondingly shaped cruciform channel 54 formed in the lower part of mounting block 26. After slide block 52 is received in channel 54, it is confined there by an end cap 56 secured to mounting block 26 by a screw 58 passing through a bore 60 formed in the mounting block and an aligned bore 62 formed in the cap 56. A spring 64 is mounted between the slide block 52 and the fixed end cap 56, which spring 64 urges slide block 52 into the cutout portion 42 of mounting block 26.

In that position, the upper projecting portion 66 of slide block 52 is received within a correspondingly shaped notch 68 in collar 40, when the playyard is in its assembled condition. With the top portion 66 of slide block 52 received in notch 68 of collar 40, the assembly of the tube 18, 22, collar 40 and end plug 38 cannot rotate relative to mounting block 26 and corner connecting member 14, and therefore the playyard cannot be collapsed.

To collapse the playyard, it is necessary first to slide the slide block 52 in the direction of arrow F, by pushing against the manual actuating surface 70 against the action of spring 64, until the projection 66 is removed from the notch 68. With the slide in this position, the user then grasps the associated hinge 20, and twists it to rotate the hinge 20/tube pair 18, 18 or 22, 22 assembly 180° about the axis of the tubes. The slide block 52 may be released as soon as the notch 68 is rotated out of alignment with the projection 66, as the projection 66 can then no longer pass back into the notch 68.

Figure 3:
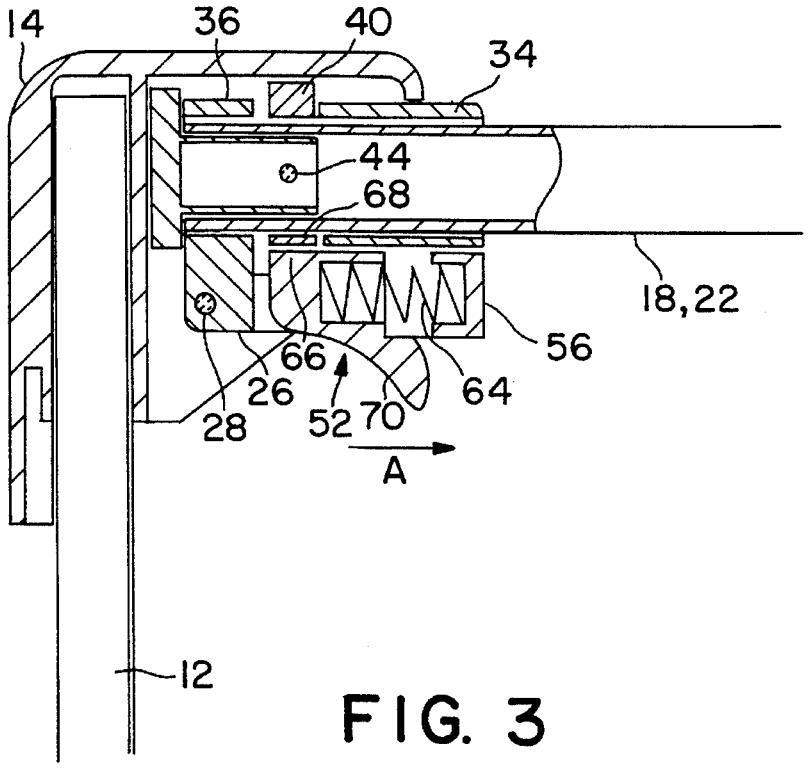
FIG. 3 is a vertical cross section of the embodiment of FIG. 2 in assembled condition, wherein the release mechanism is engaged and the top rails are locked in their assembled condition.

FIG. 3 shows the FIG. 2 structure in which the tube pair 18, 18 or 22, 22 is locked against rotation by the novel release mechanism 24. As shown in FIG. 3, spring 64 is in its relaxed position between slide block 52 and end cap 56, with projection 66 of slide block 52 occupying notch 68 formed in collar 40. Thus, the presence of projection 66 within notch 68 prevents any rotation of tube 18, 22 relative to mounting block 26.

In order to free the assembly of hinge 20/tube pair 18, 18 or 22, 22 for rotation about the axis of the tubes, it is necessary to slide the slide block 52 in the direction of the arrow A shown in FIG. 3, against the action of spring 64.

Figure 4:
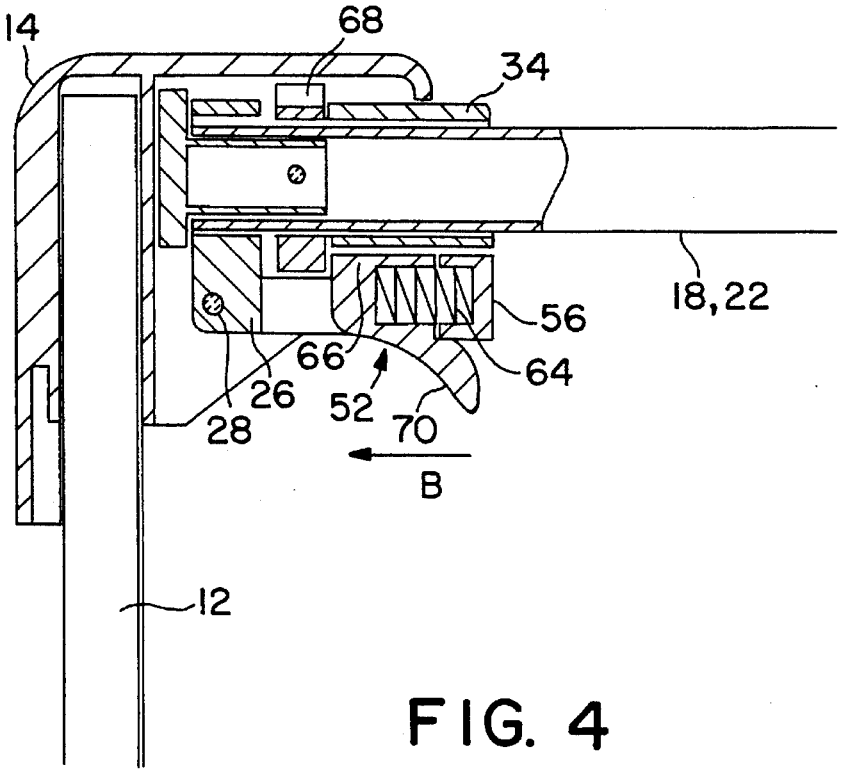
FIG. 4 is a further vertical cross section of the FIG. 2 embodiment, wherein the hinge/rail pair assembly has been rotated 180° following actuation of the release mechanism, such that the associated rail pair is ready to be collapsed.

FIG. 4 shows the resulting structure when this operation has been performed. In particular, the user has pressed against the manual actuation surface 70, thereby to slide the slide block to the right, in the direction of the arrow A of FIG. 3, and to compress spring 64 between slide block 52 and end cap 56. With the slide block in this position, the user then grasps the medial hinge 20, and rotates the hinge/tube pair assembly 180°. As soon as collar 40 has rotated sufficiently that the notch 68 is no longer in registry with projection 66, it is no longer necessary to hold the slide block 52 against the action of spring 64, because, as shown in FIG. 4, the periphery of collar 40 prevents slide block 62 from returning to its relaxed position. Once the hinge/tube pair assembly has been rotated 180°, the playyard can then be collapsed in the conventional manner, for example as described with reference to the embodiments of FIGS. 13–22 of U.S. Pat. No. 4,811,437 discussed above.

Thus, the release mechanism according to the invention permits safely maintaining the top rail structure in its assembled condition, while also allowing the structure to be collapsed by a relatively simple, yet two-handed operation. In particular, slide block 52 is moved in the direction of arrow A in FIG. 3 against the action of spring 64, and while held in the position shown in FIG. 4, the associated hinge 20 is grasped and twisted to bring the hinge/tube pair assembly into its collapsible position.

When assembling the playyard, the tubes of each tube pair are brought into their extended in-line position, at which time the release mechanism will be in the position shown in FIG. 4. The hinge is then twisted 180° to the position shown in FIG. 1. As soon as the notch 68 in collar 40 is brought in line with the projection 66 on slide block 52, the slide block 52 automatically snaps into its relaxed position wherein projection 66 occupies notch 68, and the assembly is locked against unintended release.

It will also be appreciated that, by virtue of the construction of the present invention, only one tube of each tube pair need be provided with the release mechanism according to the invention. The other tube of the tube pair is necessarily both pivotably and rotatably mounted in its associated corner connecting member 14. However, there is no need for an additional release mechanism, in contrast to the embodiments of FIGS. 13–23 of U.S. Pat. No. 4,811,437, because the release mechanism according to the invention is actuated not by grasping the rails of the top frame structure, but rather by pushing on a special manual actuating element which is disposed entirely beneath and offset from the associated rail.

Thus, the other tube of the tube pair, which is not provided with an actuating element, may be mounted via a mounting block such as that shown at 26 in FIG. 2; however, the mounting block need not have a cut-out portion 42, nor a surrounding collar 40. The other tube will preferably be retained in the mounting block by an end plug such as that shown at 38 in FIG. 2, to prevent the tube from being pulled out of the mounting block. Needless to say, the other tube of the tube pair does not include the manually actuated member such as slide block 52 with associated spring 64 and end cap 56, and the lower portion of pivot block 26 may therefore be correspondingly simplified to eliminate the cruciform channel 54.

Figure 5:
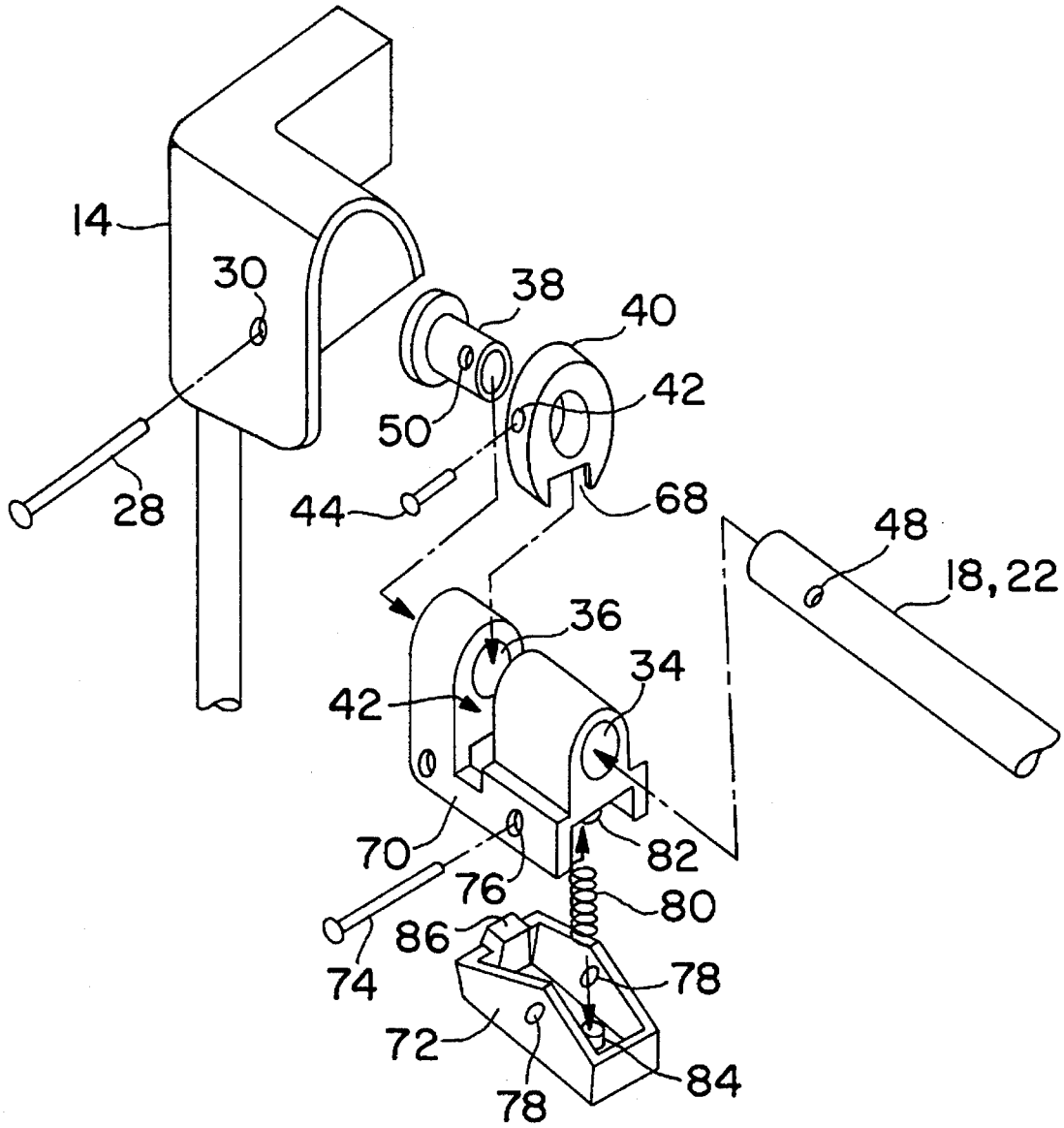
FIG. 5 is an exploded view showing the top rail release mechanism according to a second embodiment of the invention.
Figure 6:
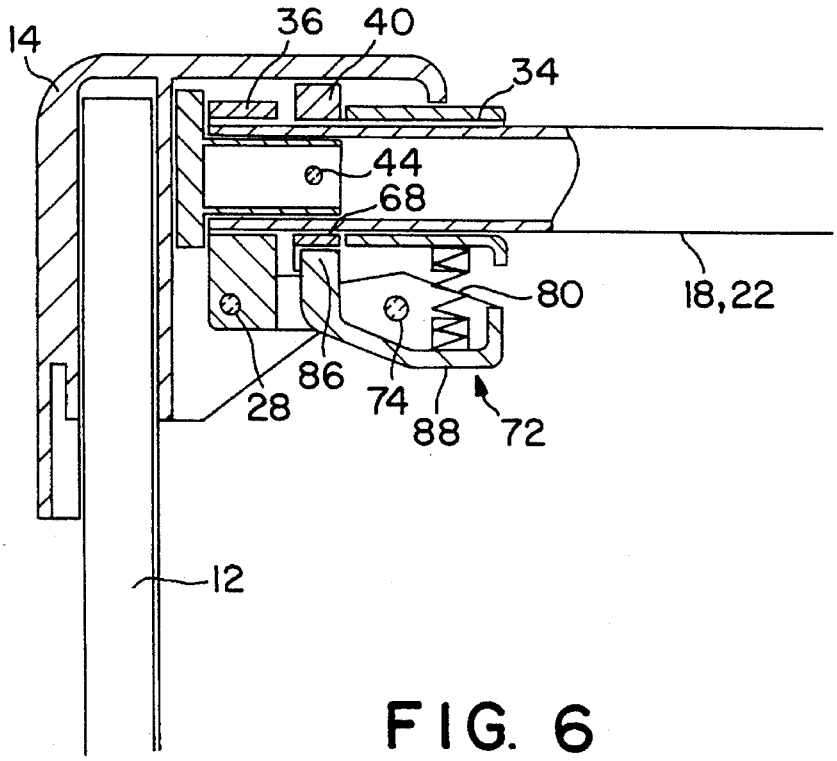
FIG. 6 is a vertical cross section of the embodiment of FIG. 5 in assembled condition, wherein the release mechanism is engaged and the top rails are locked in their assembled condition.
Figure 7:
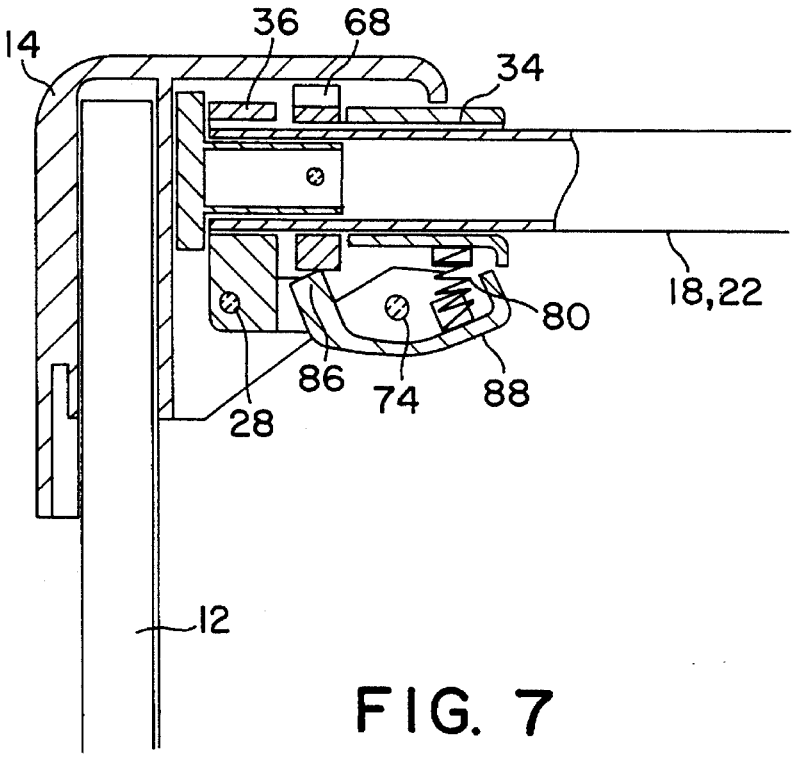
FIG. 7 is a further vertical cross section of the FIG. 5 embodiment, wherein the hinge/rail pair assembly has been rotated 180° following actuation of the release mechanism, such that the associated rail pair is ready to be collapsed.

FIGS. 5–7 are similar to FIGS. 2–4, but show the release mechanism according to a second embodiment of the invention. Like parts are designated with the same reference numerals.

As in the embodiment of FIGS. 2–4, one of the tubes 18, 22 of a tube pair 18, 18 or 22, 22 is mounted via an end plug 38 and collar 40 for rotational movement within a pivot block 70.

This embodiment differs from the previous embodiment in that the slide block 52 is replaced by a lever 72 which is pivotably mounted to the lower portion of mounting block 70 by a pin 74 passing through aligned bores 76 in mounting block 70 and bores 78 in lever 72.

The release mechanism also includes a spring 80 that is fitted generally vertically between a boss 82 provided on mounting block 70, and a boss 84 provided on lever 72.

Lever 72 further comprises a projection 86 formed at one end thereof, which performs the same function, albeit in a different way, as the projection 66 of the previous embodiment.

In particular, the spring 80 urges lever 72 to rock about pivot pin 74, such that projection 86 is urged upwardly into notch 68 of collar 40, when the playyard is in the assembled condition.

With reference to FIG. 6, the structure of this second embodiment is shown wherein the playyard is assembled and the associated hinge/tube pair assembly has been rotated to its locked position. In this condition, spring 80 is in its relatively more relaxed state, and the projection 86 present on lever 72 occupies notch 68 in collar 40. The associated hinge/tube pair assembly of the playyard is thereby locked against rotation about the axis of the tubes.

To free the hinge/tube pair assembly for rotation, the user presses upwardly on the manual actuating surface 88 of the lever 72, until lever 72 assumes the position shown in FIG. 7, that is, until projection 86 has been brought entirely out of notch 68. With lever 72 in the FIG. 7 position, the associated hinge/tube pair assembly is freed for 180° rotation about the axis of the tubes, until the position of the hinge/tube pair assembly is as shown in FIG. 7. In this position, the hinge/tube pair assembly may then be collapsed in the conventional manner.

As in the previous embodiment, it is necessary to depress lever 72 only until the hinge/tube pair assembly has been rotated to the extent that projection 86 is no longer in registry with notch 68. Thereafter, the periphery of collar 40 will prevent lever 72 from assuming its relaxed state, as shown in FIG. 7.

To assemble the playyard, the user merely extends the tubes of each hinge/tube pair assembly to their extended in-line position, and thereafter twists the medial hinge 20 by 180°. As soon as the projection 86 becomes aligned with notch 68, the action of spring 80 causes the projection to snap automatically into the locked position shown in FIG. 6.

Although the invention has been described in connection with various preferred embodiments thereof, it will be readily apparent to those skilled in the art that numerous modifications can be made without departing from the true scope and spirit of the invention as set forth in the appended claims. For example, the structure of the bottom frame of the playyard need not be as shown in FIG. 1; instead, it could also be as described in U.S. Pat. No. 5,197,154 to Louis SHAMIE, which patent is accordingly incorporated by reference for a description of that bottom frame structure.

What is claimed is:

1. A foldable playyard comprising:

an upper frame assembly having a plurality of collapsible upper rail tubes interconnected in pairs by intermediate connecting members, the rails of each pair being pivotable relative to each other via said intermediate connecting members, a collapsible lower frame assembly comprising a plurality of relatively movable rail members, floor support members interconnecting said rail members of said lower frame assembly, upper corner connecting members interconnecting said rail pairs of said upper frame assembly, vertical rails interconnecting said upper corner connecting members and said lower floor support members, and a single release mechanism for each pair of rails of the upper frame assembly, each said single release mechanism freeing its associated rail pair for rotation about the longitudinal axis of the rails.

2. The playyard according to claim 1, wherein each pair of rails of the upper frame assembly are mounted for rotational and pivotable movement relative to adjacent ones of said corner connecting members.

3. The playyard according to claim 2, wherein said intermediate connecting member is a hinge to which a said pair of rail members is rigidly connected, said hinge comprising two halves pivoting relative to one another about an axis perpendicular to and offset from the axis of the rails.

4. The playyard according to claim 1, wherein each said release mechanism comprises a manually actuated member offset from and positioned alongside one of said rails of said upper frame assembly.

5. The playyard according to claim 1, wherein each said release mechanism comprises a movable member having a projection that is selectively engageable with a recess provided on a collar member rigidly secured to one of said rails of said upper frame assembly, thereby selectively to prevent an associated rail pair from rotating about the longitudinal axis of the rails.

6. The playyard according to claim 5, wherein said manually actuated member is a slide block movable parallel to the axis of said rail pair, said release mechanism further comprising spring means urging said slide block into engagement with said recess.

7. The release mechanism according to claim 5, wherein said manually actuated member is a lever having a projection formed on one end portion thereof, said release mechanism further comprising spring means urging said projection into engagement with said recess.

8. The playyard according to claim 1, wherein each said release mechanism is disposed adjacent one of said corner connecting members, offset from and alongside an associated rail of said upper frame assembly.

9. The playyard according to claim 1, wherein each said release mechanism comprises a mounting block receiving one of said rails of said upper frame assembly, said mounting block being pivotably mounted to one of said corner connecting members, said rail being rotatable relative to said mounting block, and a collar rigidly secured to said rail, said collar comprising a peripheral notch, said mounting block further comprising a manually actuable member movably mounted thereon, said manually actuable member comprising a projection selectively engageable in said notch to lock said rail against rotation relative to said mounting block.

* * * * *